US006427245B1

(12) United States Patent
Alcala

(10) Patent No.: US 6,427,245 B1
(45) Date of Patent: Aug. 6, 2002

(54) NECKTIE KNOT COVER

(76) Inventor: Edgardo N. Alcala, Dr. 1/2 Villacorta Apt., Rivera Drive, Bajada, Davao City (PH), 8000

( * ) Notice: Subject to any disclaimer, the term of this patent is extended or adjusted under 35 U.S.C. 154(b) by 0 days.

(21) Appl. No.: 09/924,642

(22) Filed: Aug. 8, 2001

(51) Int. Cl.[7] ..... A41D 25/08
(52) U.S. Cl. ..... 2/152.1
(58) Field of Search ..... 2/152.1, 144, 145, 2/150, 151, 156, 153, 916; 24/49.1, 52, 59, 66.8

(56) References Cited

U.S. PATENT DOCUMENTS

| | | | | | |
|---|---|---|---|---|---|
| 485,447 | A | * | 11/1892 | Beam | 24/49.1 |
| 1,349,486 | A | * | 8/1920 | Bakerman | 2/152.1 |
| 1,887,104 | A | * | 11/1932 | Roberts | 2/152.1 |
| 2,646,668 | A | * | 7/1953 | Rinehart | 2/152.1 |
| 2,898,600 | A | | 8/1959 | Lipes et al. | |
| 3,665,519 | A | * | 5/1972 | Calhoun | 2/150 |
| 3,745,614 | A | * | 7/1973 | Tsang | 24/153 |
| 3,964,105 | A | | 6/1976 | Gideon | |
| 4,489,443 | A | * | 12/1984 | Ellin | 2/153 |
| 5,010,593 | A | | 4/1991 | Stevens, Jr. | |
| 5,666,666 | A | | 9/1997 | Chaffen et al. | |

* cited by examiner

*Primary Examiner*—Gloria M. Hale
*Assistant Examiner*—Tejash Patel
(74) *Attorney, Agent, or Firm*—Jack Lo

(57) ABSTRACT

A necktie knot cover is comprised of a sheet with a center portion for being positioned against a necktie knot, and backwardly curved side panels for hugging the sides of the knot for stability. The sheet has two inwardly slanted side edges below its top edge. The top ends of the side panels terminate at the lower ends of the slanted side edges. The slanted side edges provide clearance for the loop of the necktie. A mounting bracket is attached to an inner surface of the center portion. A spring-loaded arm is hinged to the bracket. The arm is for hooking inside a pocket below a top edge of the knot. The arm has inwardly curved fingers for gripping the inside of the pocket.

7 Claims, 4 Drawing Sheets

NECKTIE KNOT COVER

BACKGROUND OF THE INVENTION

1. Field of the Invention

This invention relates generally to covers for necktie knots.

2. Prior Art

The knot of a necktie is the most prominent feature of the necktie, especially when the rest of the tie is covered by a jacket or coat. Tying a necktie to produce a nice knot and the proper length at the dangling portions is a trial and error process for many people. The material at the knot can become worn out quickly because of the abrasion that results from retying the necktie several times for each time it is worn.

Knot covers have been invented to provide additional decoration at the most visible part of the necktie, and to conceal any worn out material. U.S. Pat. No. 5,010,593 to Stevens, Jr. shows a knot cover comprising a sheet with side flaps that fold backward to wrap completely around the knot. The sides are secured together with hook-and-loop fasteners. A top strap extending from the top edge of the sheet is wrapped around the top of the knot and secured to the flaps with hook-and- loop fasteners. Having to wrap the sheet around the knot and secure multiple fasteners makes this device difficult to put on.

Simulated knots have also been invented to eliminate the need to make a knot. U.S. Pat.2,898,600 to Lipes et al. shows a simulated knot c curve completely around the back of the sheet. A hinged arm is attached to the inner side of the sheet. The arm is not spring loaded. It cannot be conveniently used as a knob cover because the back of the sheet is almost completely closed, so that the necktie must be threaded through the top opening of the device. It would also be unstable as a knot cover because the arm does not exert any force to clamp against the necktie.

U.S. Pat.3,964,105 to Gideon shows another simulated knot comprising a curved sheet with spring loaded clips for attaching to a necktie. The sides of the sheet are too flat to hug the tie for stability. The clips are hinged about vertical axes, so that it cannot be clipped onto a real knot as a knot cover.

U.S. Pat.No.5,666,666 to Chaffen et al. shows yet another simulated knot comprising a sheet which is folded to form a knot shape. It cannot be used as a knot cover because there is no structure for attaching it to a real knot.

Spring loaded clips for earrings are well known. A typical earring clip 40 is shown in FIGS. 1 and 2. However, similar clips have not been provided on necktie covers. Further, clip 40 has an arm 41 with only a single gripping point 42. Even if clip 40 is provided on a necktie knot cover, it would not be able to stabilize the cover.

OBJECTS OF THE INVENTION

The objects of the present necktie knot cover are:

to cover a necktie knot;

to provide a surface for arranging decoration;

to be easy to install; and to be stable on the knot.

Further objectives of the present invention will become apparent from a consideration of the drawings and ensuing description.

BRIEF SUMMARY OF THE INVENTION

A necktie knot cover is comprised of a sheet with a center portion for being positioned against a necktie knot, and backwardly curved side panels for hugging the sides of the knot for stability. The sheet has two inwardly slanted side edges below its top edge. The top ends of the side panels terminate at the lower ends of the slanted side edges. The slanted side edges provide clearance for the loop of the necktie. A mounting bracket is attached to an inner surface of the center portion. A spring-loaded arm is hinged to the bracket. The arm is for hooking inside a pocket below a top edge of the knot. The arm has inwardly curved fingers for gripping the inside of the pocket.

DRAWING REFERENCE NUMERALS

| | |
|---|---|
| 10. Sheet | 11. Center Portion |
| 12. Side Panels | 13. Slanted Side Edges |
| 14. Horizontal Top Edge | 15. Rear Edges |
| 16. Mounting Bracket | 17. Arm |
| 18. Projecting Portion | 19. Pivots |
| 20. Side Fingers | 21. Forked Fingers |
| 22. Trapping Notch | 23. Necktie Knot |
| 24. Necktie | 25. Loop |
| 26. Pocket | 27. Top Edge |
| 30. Sheet | 31. Side Panels |
| 32. Top Edge | 33. Bottom Edge |
| 34. Mounting Bracket | 35. Arm |
| 36. Projecting Portion | 37. Pivots |
| 38. Side Fingers | 39. Side Fingers |
| 40. Earring Clip | 41. Arm |
| 42. Gripping Point | |

DETAILED DESCRIPTION OF THE INVENTION

Figure 1:
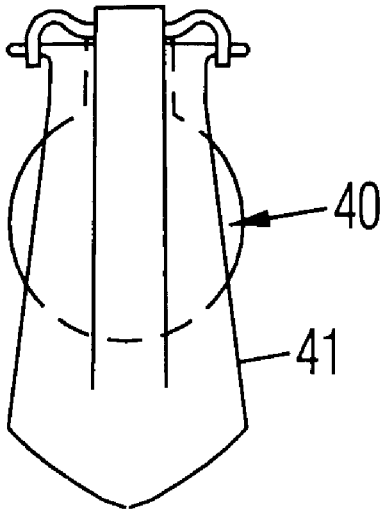
Fig. 1 Prior Art
FIG. 1 is a rear view of a prior art earring clip.
Figure 2:
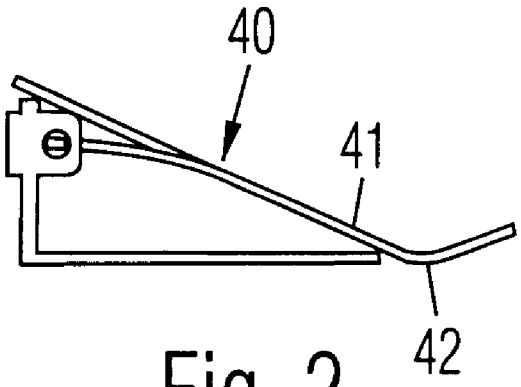
Fig. 2 Prior Art
FIG. 2 is a side view of the earring clip.
Figure 3:
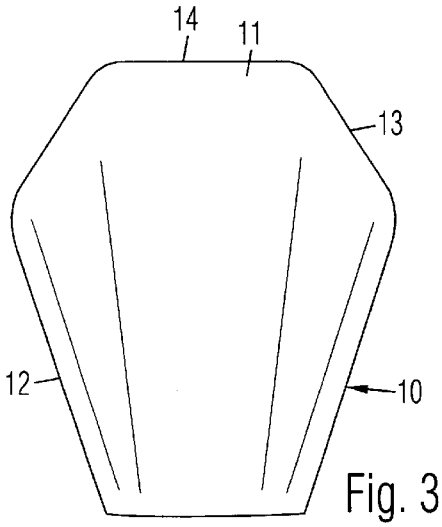
FIG. 3 is a front view of the present necktie knot cover.
Figure 4:
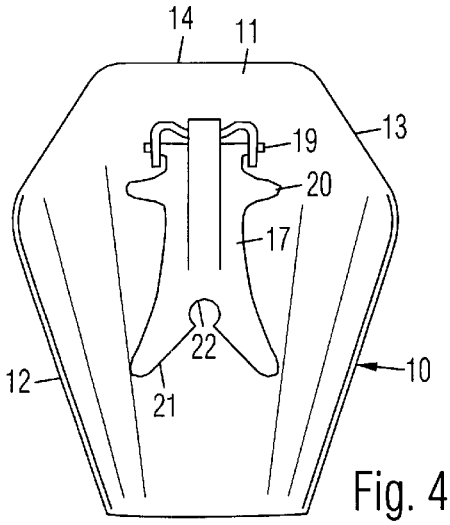
FIG. 4 is a rear view of the knot cover.
Figure 5:
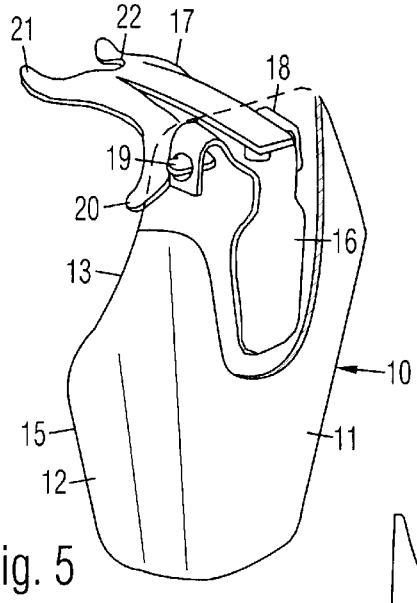
FIG. 5 is a front perspective cutaway of the knot cover with a hinged arm in an open position.
Figure 6:
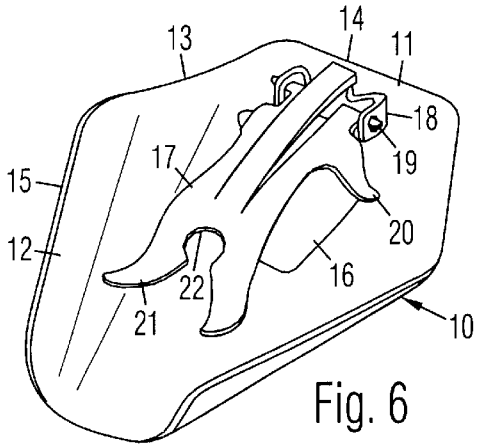
FIG. 6 is a rear perspective view of the knot cover with the arm in a closed position.
Figure 7:
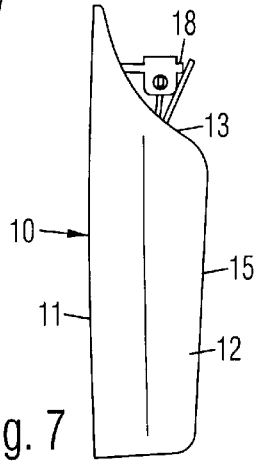
FIG. 7 is a side view of the knot cover.
Figure 8:
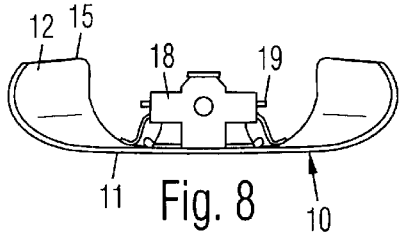
FIG. 8 is a top view of the knot cover.

FIGS. 1–9:

A first embodiment of the present necktie knot cover is shown in FIGS. 1–9. It is comprised of a generally rigid sheet 10 with a center portion 11, and backwardly curved side panels 12. Sheet 10 may be made of any suitable material, such as metal, plastic, paiper mache, etc. The front of sheet 10 provides a surface for applying graphics and other decorations. The top ends of side panels 12 terminate at the lower ends of two inwardly slanted side edges 13 below a horizontal top edge 14 of sheet 10. Side panels 12 are generally perpendicular to front portion 11, as shown in FIG. 8, and terminate in rear edges 15 to leave the back of sheet 10 completely open. A mounting bracket 16 is attached to the inner surface of sheet 10. A spring-loaded arm 17 has a top end hinged to an outwardly projecting portion 18 of bracket 16 by horizontal pivots 19. Arm 17 has a pair of side fingers 20 at its sides near its top end curving toward sheet 10, and a pair of forked fingers 21 at its lower end also curving toward sheet 10. A circular trapping notch 22 is arranged between forked fingers 21.

Figure 9:
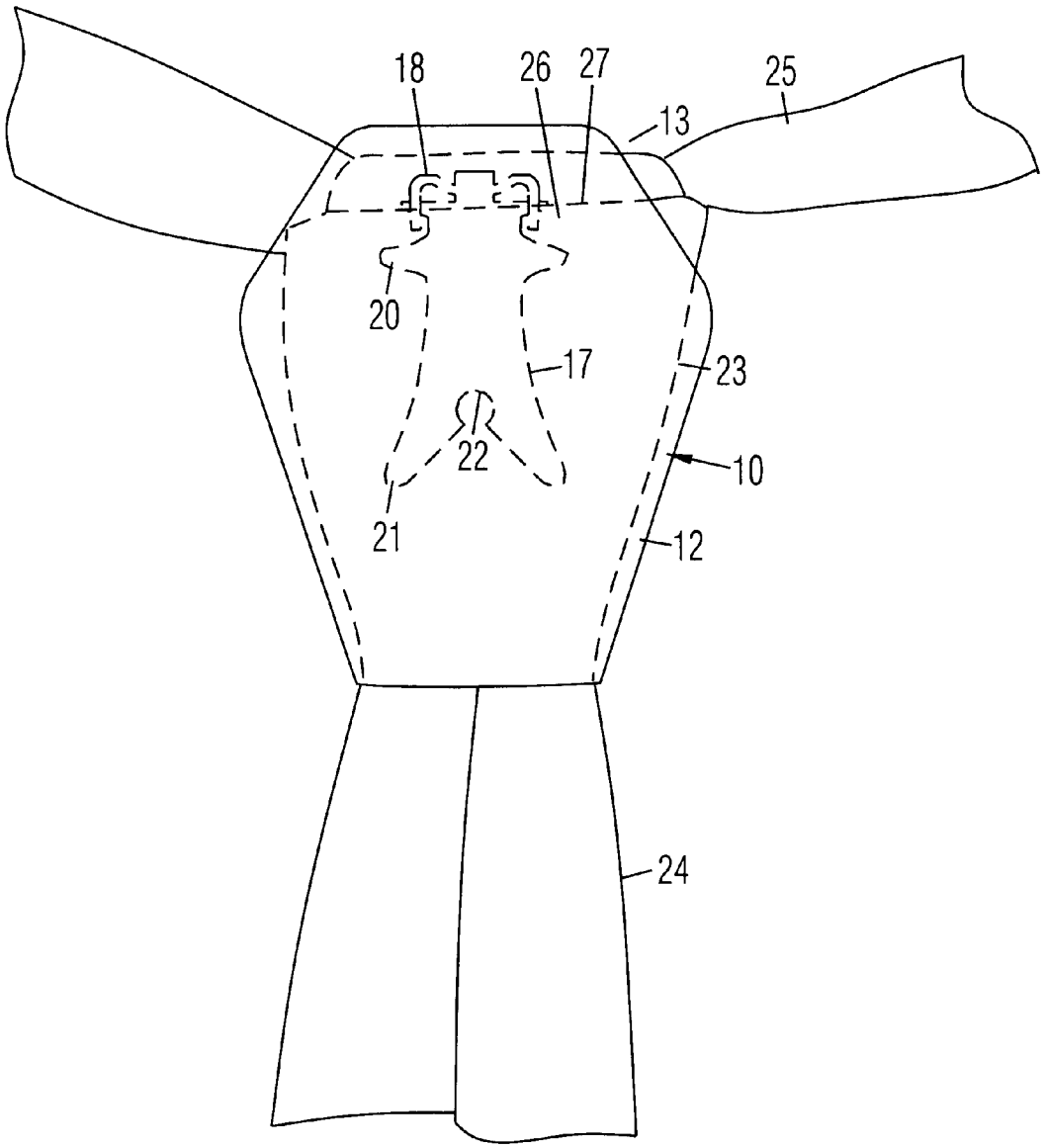
FIG. 9 is a front view of the knot cover attached to a necktie knot.

The present cover is shown attached to a knot 23 of a necktie 24 in FIG. 9. Sheet 10 is easily positioned against knot 23 because its back is completely open, yet it is stable because side panels 12 closely hug the sides of knot 23. Slanted side edges 13 provide clearance for a loop 25 of necktie 24. Arm 17 is hooked inside a pocket 26 below a top edge 27 of knot 23 to support cover 10. Inwardly curved side fingers 20 and inwardly curved forked fingers 21 on spring-loaded arm 17 are biased tightly against the inside of pocket 26 for further stability. Trapping notch 22 is gripped around the fabric of necktie 24 for even greater stability.

Figure 10:
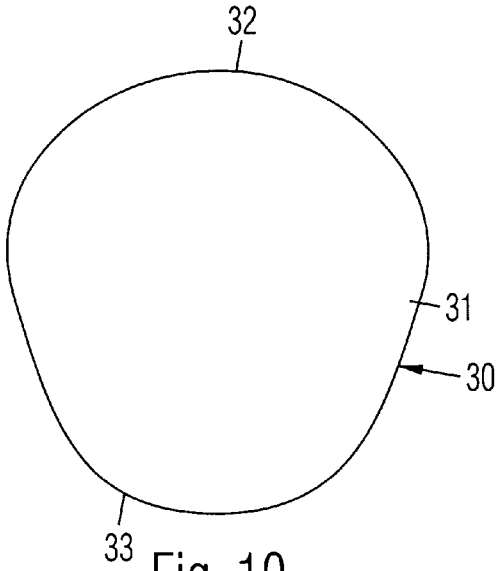
FIG. 10 is a front view of an alternative embodiment of the knot cover.
Figure 11:
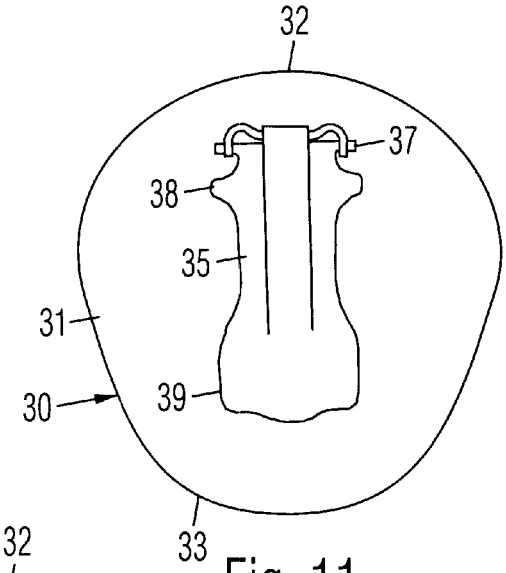
FIG. 11 is a rear view of the alternative embodiment.
Figure 12:
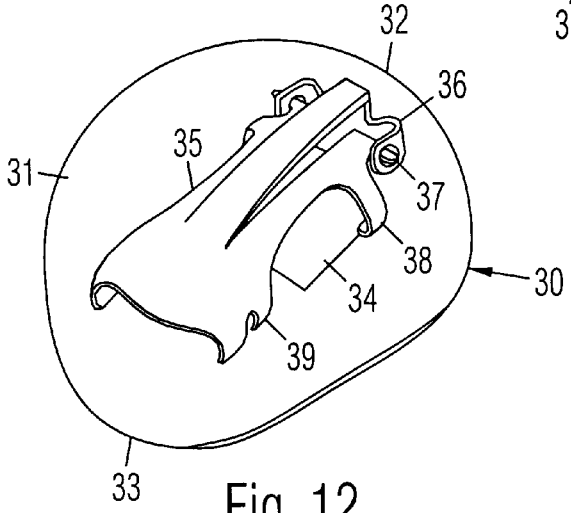
FIG. 12 is a rear perspective view of the alternative embodiment.

FIGS. 10–12:

An alternative embodiment of the necktie knot cover is shown in FIGS. 10–12. It is comprised of a sheet 30 with curved side panels 31, a rounded top edge 32, and a rounded bottom edge 33.

Other shapes for the sheet are possible. A mounting bracket 34 is attached to the inner surface of sheet 30. A spring-loaded arm 35 has a top end hinged to an outwardly projecting portion 36 of bracket 34 by horizontal pivots 37. Arm 35 has a pair of upper side fingers 38 on its sides near its top end curving toward sheet 30, and two pairs of lower side fingers 39 on its sides near its lower end also curving toward sheet 30 for securely gripping the necktie.

SUMMARY AND SCOPE

Accordingly, the present necktie knot cover covers a necktie knot. It provides a surface for arranging decoration. It is easy to install. It is also stable on the knot.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. The sheet may be provided in other shapes and sizes. Therefore, the scope of the invention should be determined by the appended claims and their legal equivalents, not by the examples given.

I claim:

1. A necktie knot cover for a knot of a necktie, comprising:

a sheet with a center portion for being positioned vertically against said knot;

a pair of side panels curving backward from said center portion of said sheet for hugging opposite sides of said knot, wherein said side panels terminate in rear ends which are generally perpendicular to said center portion, so as to leave a back of said sheet completely open for facilitating installation on said knot; and a spring-loaded arm with a top end hinged to an inner surface of said sheet by horizontal pivots, and a downwardly projecting lower end for being hooked inside a pocket below a top edge of said knot.

2. The necktie knot cover of claim 1, further including a pair of side fingers on opposite sides of said arm curving toward said sheet for gripping an inner surface of said pocket;

a pair of forked fingers at a lower end of said arm curving toward said sheet for gripping an inner surface of said pocket; and a circular notch between said forked fingers for trapping necktie material on said inner surface of said pocket.

3. The necktie knot cover of claim 1, further including a pair of upper side fingers on opposite sides of said arm near a top end of said arm curving toward said sheet, and two pairs of side fingers on said opposite sides of said arm near a lower end of said arm curving toward said sheet for gripping an inner surface of said pocket.

4. A necktie knot cover for a knot of a necktie, comprising:

a sheet with a center portion for being positioned vertically against said knot;

a pair of side panels curving backward from said center portion of said sheet for hugging opposite sides of said knot, wherein said side panels are generally perpendicular to said center portion;

a pair of inwardly slanted side edges on said sheet above said side panels and below a horizontal top edge of said sheet for providing clearance for a loop of said necktie;

wherein top ends of said side panels terminate at lower ends of said slanted side edges, and rear ends of said side panels terminate in rear edges to leave a back of said sheet completely open for facilitating installation on said knot; and a spring-loaded arm with a top end hinged to an inner surface of said sheet by horizontal pivots, and a lower end for being hooked inside a pocket below a top edge of said knot.

5. The necktie knot cover of claim 4, further including a pair of side fingers on opposite sides of said arm curving toward said sheet for gripping an inner surface of said pocket;

a pair of forked fingers at a lower end of said arm curving toward said sheet for gripping an inner surface of said pocket; and a circular notch between said forked fingers for trapping necktie material on said inner surface of said pocket.

6. The necktie knot cover of claim 4, further including a pair of upper side fingers on opposite sides of said arm near a top end of said arm curving toward said sheet, and two pairs of side fingers on said opposite sides of said arm near a lower end of said arm curving toward said sheet for gripping an inner surface of said pocket.

7. A necktie knot cover for a knot of a necktie, comprising:

a sheet with a center portion for being positioned vertically against said knot;

a pair of side panels curving backward from said center portion of said sheet for hugging opposite sides of said knot, wherein said side panels are generally perpendicular to said center portion;

a pair of inwardly slanted side edges on said sheet above said side panels and below a horizontal top edge of said sheet for providing clearance for a loop of said necktie;

wherein top ends of said side panels terminate at lower ends of said slanted side edges, and rear ends of said side panels terminate in rear edges to leave a back of said sheet completely open for facilitating installation on said knot;

a mounting bracket attached to an inner surface of said center portion of said sheet;

a spring-loaded arm with a top end hinged to an outwardly projecting portion of said bracket by horizontal pivots, and a lower end for being hooked inside a pocket below a top edge of said knot;

a pair of side fingers on opposite sides of said arm curving toward said sheet for gripping an inner surface of said pocket;

a pair of forked fingers at a lower end of said arm curving toward said sheet for gripping an inner surface of said pocket; and a circular notch between said forked fingers for trapping necktie material on said inner surface of said pocket.

* * * * *